US009928743B2

(12) United States Patent
Eilertsen

(10) Patent No.: US 9,928,743 B2
(45) Date of Patent: Mar. 27, 2018

(54) ROAD TRAFFIC SERVER

(71) Applicant: Roger André Eilertsen, Askim (NO)

(72) Inventor: Roger André Eilertsen, Askim (NO)

( * ) Notice: Subject to any disclaimer, the term of this patent is extended or adjusted under 35 U.S.C. 154(b) by 0 days.

(21) Appl. No.: 15/308,519

(22) PCT Filed: May 4, 2015

(86) PCT No.: PCT/NO2015/000009
§ 371 (c)(1),
(2) Date: Nov. 2, 2016

(87) PCT Pub. No.: WO2015/170990
PCT Pub. Date: Nov. 12, 2015

(65) Prior Publication Data

US 2017/0098372 A1 Apr. 6, 2017

(30) Foreign Application Priority Data

May 4, 2014 (NO) ..... 20140566
Nov. 9, 2014 (NO) ..... 20141332

(51) Int. Cl.
*G08G 1/09* (2006.01)
*G08G 1/0967* (2006.01)
*G08G 1/01* (2006.01)

(52) U.S. Cl.
CPC ..... *G08G 1/096775* (2013.01); *G08G 1/0133* (2013.01)

(58) Field of Classification Search
CPC .. G08G 1/096775; G08G 1/0133; G08G 1/00; G08G 1/0129; G08G 1/096741; G08G 1/096844; G08G 1/096888; G01C 21/3461; G01C 21/3492; G01C 21/3453
USPC ..... 340/905, 988, 990, 991, 992, 993, 994, 340/995.1, 995.13, 995.17, 995.19, 995.2, 340/995.21; 701/117, 118, 119, 439, 442, 701/465, 466, 515
See application file for complete search history.

(56) References Cited

U.S. PATENT DOCUMENTS 6,317,686 B1 * 11/2001 Ran ..... G01C 21/3691 701/117
8,306,556 B2 11/2012 Chao et al.
9,086,291 B1 * 7/2015 Bhatia ..... G01C 21/3461
2002/0065599 A1 5/2002 Hameleers et al.
2003/0018428 A1 1/2003 Knockeart et al.
2008/0234921 A1 9/2008 Groenhuijzen et al.
(Continued)

FOREIGN PATENT DOCUMENTS

EP 2 323 115 5/2011
WO 2012/122448 9/2012
(Continued)

OTHER PUBLICATIONS

International Search Report dated Aug. 21, 2015 in corresponding International Application No. PCT/NO2015/000009.

*Primary Examiner* — Anh V La
(74) *Attorney, Agent, or Firm* — Wenderoth, Lind & Ponack, L.L.P.

(57) ABSTRACT

The present invention relates to road traffic information and guidance server systems, and a method thereof, and especially to a traffic information and guidance server system providing distribution of targeted traffic related information and guidance to road users located at specific geographical locations, and a method thereof.

23 Claims, 7 Drawing Sheets

(56) References Cited

U.S. PATENT DOCUMENTS

| | | | | |
|---|---|---|---|---|
| 2009/0177373 | A1* | 7/2009 | Groenhuijzen ..... | G01C 21/36<br>701/117 |
| 2011/0246594 | A1 | 10/2011 | Cobbold | |
| 2013/0289864 | A1 | 10/2013 | Miller et al. | |
| 2014/0278031 | A1* | 9/2014 | Scofield ..... | G08G 1/00<br>701/118 |

FOREIGN PATENT DOCUMENTS

| | | |
|---|---|---|
| WO | 2013/033560 | 3/2013 |
| WO | 2014/114751 | 7/2014 |

* cited by examiner

Event List

| Line | Text (CEN-English) | Text (Norwegian) | Code | N | Q | T | D | U | C | R |
|---|---|---|---|---|---|---|---|---|---|---|
| 38 | traffic congestion, average speed of 20 km/h | trafikkork, hastighet 20 km/t | 71 | | | D | 1 | U | 1 | A920 |
| 39 | traffic congestion, average speed of 30 km/h | trafikkork, hastighet 30 km/t | 72 | | | D | 1 | U | 1 | A930 |
| 40 | traffic congestion, average speed of 40 km/h | trafikkork, hastighet 40 km/t | 73 | | | D | 1 | U | 1 | A940 |
| 41 | traffic congestion, average speed of 50 km/h | trafikkork, hastighet 50 km/t | 74 | | | D | 1 | | 1 | A950 |
| 42 | traffic congestion, average speed of 60 km/h | trafikkork, hastighet 60 km/t | 75 | | | D | 1 | | 1 | A960 |
| 43 | traffic congestion, average speed of 70 km/h | trafikkork, hastighet 70 km/t | 76 | | | D | 1 | | 1 | A970 |
| 44 | traffic lighter than normal (with average speeds Q) | mindre trafikk enn normalt (med hastighet Q) | 137 | | 4 | D | 1 | | 1 | A19 |
| 45 | queuing traffic (with average speeds Q). Approach with care | fare for kø (med hastighet Q), kjør forsiktig | 138 | | 4 | D | 1 | U | 1 | A2.Z112 |
| 46 | queuing traffic around a bend in the road | fare for kø etter sving | 139 | | | D | 1 | U | 1 | A2.Z165 |
| 47 | queuing traffic over the crest of a hill | fare for kø etter bakketopp | 140 | | | D | 1 | U | 1 | A2.Z166 |
| 48 | queuing traffic (with average speeds Q). Danger of stationary traffic | saktegående kø (med hastighet Q), med fare for stillestående trafikk | 2 | | 4 | D | 1 | U | 1 | A2.A1D |
| 49 | (Q) accident(s). Stationary traffic | stillestående trafikk på grunn av (Q) trafikkuhell | 215 | | 0 | D | 1 | U | 1 | B1.A1 |
| 50 | (Q) accident(s). Stationary traffic for 1 km | stillestående trafikk i 1 km på grunn av (Q) trafikkuhell | 216 | | 0 | D | 1 | U | 1 | B1.A101 |
| 51 | (Q) accident(s). Stationary traffic for 2 km | stillestående trafikk i 2 km på grunn av (Q) trafikkuhell | 217 | | 0 | D | 1 | U | 1 | B1.A102 |
| 52 | (Q) accident(s). Stationary traffic for 3 km | stillestående trafikk i 3 km på grunn av (Q) trafikkuhell | 348 | | 0 | D | 1 | U | 1 | B1.A103 |
| 53 | (Q) accident(s). Stationary traffic for 4 km | stillestående trafikk i 4 km på grunn av (Q) trafikkuhell | 218 | | 0 | D | 1 | U | 1 | B1.A104 |
| 54 | (Q) accident(s). Stationary traffic for 6 km | stillestående trafikk i 6 km på grunn av (Q) trafikkuhell | 219 | | 0 | D | 1 | U | 1 | B1.A106 |
| 55 | (Q) accident(s). Stationary traffic for 10 km | stillestående trafikk i 10 km på grunn av (Q) trafikkuhell | 220 | | 0 | D | 1 | U | 1 | B1.A110 |
| 56 | (Q) accident(s). Danger of stationary traffic | fare for stillestående trafikk på grunn av (Q) trafikkuhell | 221 | | 0 | D | 1 | U | 1 | B1.A1D |
| 57 | (Q) accident(s). Queuing traffic | meget saktegående trafikk på grunn av (Q) trafikkuhell | 222 | | 0 | D | 1 | U | 1 | B1.A2 |
| 58 | (Q) accident(s). Queuing traffic for 1 km | meget saktegående trafikk i 1 km på grunn av (Q) trafikkuhell | 223 | | 0 | D | 1 | U | 1 | B1.A201 |
| 59 | (Q) accident(s). Queuing traffic for 2 km | meget saktegående trafikk i 2 km på grunn av (Q) trafikkuhell | 224 | | 0 | D | 1 | U | 1 | B1.A202 |
| 60 | (Q) accident(s). Queuing traffic for 3 km | meget saktegående trafikk i 3 km på grunn av (Q) trafikkuhell | 349 | | 0 | D | 1 | U | 1 | B1.A203 |
| 61 | (Q) accident(s). Queuing traffic for 4 km | meget saktegående trafikk i 4 km på grunn av (Q) trafikkuhell | 225 | | 0 | D | 1 | U | 1 | B1.A204 |
| 62 | (Q) accident(s). Queuing traffic for 6 km | meget saktegående trafikk i 6 km på grunn av (Q) trafikkuhell | 226 | | 0 | D | 1 | U | 1 | B1.A206 |
| 63 | (Q) accident(s). Queuing traffic for 10 km | meget saktegående trafikk i 10 km på grunn av (Q) trafikkuhell | 227 | | 0 | D | 1 | U | 1 | B1.A210 |
| 64 | (Q) accident(s). Danger of queuing traffic | fare for meget saktegående trafikk på grunn av (Q) trafikkuhell | 228 | | 0 | D | 1 | U | 1 | B1.A2D |
| 65 | (Q) accident(s). Slow traffic | saktegående trafikk på grunn av (Q) trafikkuhell | 229 | | 0 | D | 1 | U | 1 | B1.A3 |
| 66 | (Q) accident(s). Slow traffic for 1 km | saktegående trafikk i 1 km på grunn av (Q) trafikkuhell | 230 | | 0 | D | 1 | U | 1 | B1.A301 |
| 67 | (Q) accident(s). Slow traffic for 2 km | saktegående trafikk i 2 km på grunn av (Q) trafikkuhell | 231 | | 0 | D | 1 | U | 1 | B1.A302 |
| 68 | (Q) accident(s). Slow traffic for 3 km | saktegående trafikk i 3 km på grunn av (Q) trafikkuhell | 350 | | 0 | D | 1 | U | 1 | B1.A303 |
| 69 | (Q) accident(s). Slow traffic for 4 km | saktegående trafikk i 4 km på grunn av (Q) trafikkuhell | 232 | | 0 | D | 1 | U | 1 | B1.A304 |

Figure 7

ROAD TRAFFIC SERVER

TECHNICAL FIELD

The present invention relates to road traffic information and guidance server systems, and a method thereof, and especially to a traffic information and guidance server system providing distribution of targeted traffic related information and guidance to road users located at specific geographical locations, and a method thereof.

BACKGROUND

Traffic information and guidance systems are more and more important tools to be able to cope with traffic conditions in cities and on densely trafficked highways.

In prior art it is known how to utilize Global Positioning System (GPS) transceivers in navigation terminals installed in cars, and how pedestrians can find destinations when walking and being guided by for example apps from Google Map installed in Smartphones being equipped with GPS transceivers.

Such solutions are usually of great help, but there may be incidents for example which can block or which require changes of a selected route after a navigation terminal for example has calculated an optimal route to follow. Further, if many road users are travelling at the same time, for example to a major sport event, the optimal route found by a navigation tool may no longer be an optimal route. This scenario illustrates an important aspect of road guidance systems since an optimal route in the sense of being objectively the shortest route between two geographical locations may not subjectively be viewed or be experienced as an optimal route by all road users. The time of travel between two points are of course important, but there might also exist road user preferences like a personal perception about what is the best route to follow, or a road user wants to pass a certain point of interest like a viewpoint, or a restaurant etc. Therefore, it is necessary with a more complex measure of an optimal route like a metric that takes into account both objective measurable traffic conditions as well as subjective user preferences having an impact on a specific traffic advice or guidance.

There exist prior art mathematical theories that can model some typical examples of user behaviour in traffic and the impact on road conditions. For example, it is common to look at game theory and one important concept is the concept of Nash equilibrium. A simple way of explaining the concept of the Nash equilibrium related to traffic is by a simple example of two road users. Road user A and road user B are in Nash equilibrium if road user A is making the best decision for a travel route by taking into account road user B's decision for his travel route, and road user B is making the best decision he can by taking into account road user A's decision. Likewise, a group of road users are in Nash equilibrium if each one is making the best decision about the traffic that he or she can do by taking into account the decisions of the others in the traffic.

Another interesting aspect of road conditions and improvement of traffic flow is the availability of road capacity between a starting point and a destination point. One could believe that the traffic flow with respect to travel time between these points would improve if the road capacity increases. However, a German mathematician Dietrich Braess found what is denoted the Braess paradox. The paradox states that adding extra capacity to a network when moving entities selfishly choose their own routes in the network may reduce overall performance. This is because the Nash equilibrium of such a system is not necessarily optimal. Selfish behaviour does not favour cooperation between road users in the traffic.

For example, in Seoul in South Korea an increase in traffic flow capacity around the city were found when removing an existing motorway segment. In Stuttgart in Germany, in 1969, a new road network did not provide the expected improvement in travel time before closing a new section of the road for traffic. The same phenomena occurred in New York City in 1990 when traffic in the $42^{nd}$ street was blocked. This reduced the traffic congestion in the area.

Traffic flow problems are phenomena that interests mathematicians and development of many theories and empirical models trying to make traffic forecasts about traffic conditions are popular in the mathematical community.

Frank Knight did some of the first attempts to produce a mathematical theory with respect to traffic flow in the 1920s. The attempts provided a theory of traffic equilibrium, which was refined into Wardrop's first and second principles of equilibrium in 1952.

Even with the significant computer processing power that exists today there has been no substantial results from systems applied to real traffic flow conditions. Current traffic models uses a mixture of empirical and theoretical techniques. These models are then making traffic forecasts and the forecasts tries to identify areas of congestion where the current traffic on roads needs rerouting.

Therefore, not just only physical conditions provide basis for proper guidance in traffic. A combination of physical available capacity and user behaviour and preferences with respect to utilizing available capacity of road systems is the foundations for proper advices and guidance in the traffic.

The psychological aspect of road user behaviour is best illustrated by the simple fact that most road users that need to make a deviation from an intended route due to traffic congestion for example, will choose what appears to be the best alternative route around the problem. When everyone makes the same alternative route, which usually is an obvious choice, this route will probably soon experience congestion also. When applying a navigation tool to find an alternative route, the algorithm will probably also propose the same route to everyone using the same navigation system or algorithm.

Accidents or incidents are happening at random and prediction in advance is impossible, which is adding complexity to the problem. Further, the impact on traffic flow due to an accident or incident is not always evident. Road traffic passing a location of a road accident will of course be influenced by the accident, for example just by the fact that it is human to slow down the speed and look at what has happened. If the traffic slows down and the traffic density is high, the lower speed condition may start to propagate throughout a larger and larger area. Therefore, an accident or incident is seldom a stationary phenomenon limited to a certain geographical area, but is a situation that can have a growing impact on traffic conditions over time, but being limited within a specific geographical area, and/or affect a larger part of the geographical area over time. Reversal of the situation will usually happen when for example emergency agencies starts to clean up after an accident or incident. First, the size of the affected area may start to decrease, and over time the traffic conditions in the area of the accident will return to the traffic situation before the accident. Therefore, a road accident or incidents in the traffic will be associated with an impact factor magnitude reflecting seriousness of a traffic incident or event, and an impact area size around the accident or incident that respectively are functions of time.

Even planned road works may appear to road users as an unexpected incident because it may happen they missed a notice informing about the work in progress in the news, or have overlooked an information display detailing the road work before they arrived at an area affected by the road work. It could also be that a signpost has not yet been put in place.

From a road user's perspective, the road user may activate a navigation terminal and enter a planned destination. The system then calculates a route to follow, and if there is an accident or incident that will influence the traffic conditions somewhere along the calculated route, a traffic server may online notify the navigation tool, and the navigation system can provide an alternative route online even when travelling.

The time dependency of the impact factor magnitude and impact area size can make the proposals of alternative routes made by the navigation system discussed above obsolete. During the time span from the notification of the accident or incident from a traffic server until a road user approaches the impact area, the impact area size can for example grow. Dependent on current position of the car, there might no longer exist any alternative route out of the area since the time dependent evolution of the accident or incident now locks (due to emerging queues blocking junctions for example) the possible alternative routes out of the area.

Therefore, besides time dependent impact factor magnitude and time dependent impact area size, there will also be a time and distance dependent point of a specific location relative to for example an incident or event where a road user can or should be notified about the traffic problems ahead of him. According to an aspect of the present invention, such a location should serve as a decision point for the road user, wherein the road user can receive guidance and where the road user can decide about his further travelling. The road user may also receive an advice from a traffic server monitoring traffic conditions, for example about alternative roads. Before a road user passes a location of a decision point there are available alternative routes around the specific traffic problem by definition. If no available alternative routes were available after passing the decision point there would be nothing to decide, hence not a decision point.

Due to the dynamic behaviour of an impact factor magnitude and an impact area size, the relevance of traffic messages related to an incident or event may be short lived. Therefore, a traffic server system intending to provide correct traffic information and/or advice to road users can only rely on up to date information. However, the question remains when a traffic server can submit which specific up to date information to which road user. On one hand, a traffic server may acquire traffic information from police, fire brigades, from TV stations monitoring traffic from helicopters etc. On the other hand, only the road user knows which specific routes the road user will follow, and therefore only the road user can decide which specific traffic information and guidance a traffic server can provide for him. If the road user request such information too early, the information may be obsolete when arriving at a destination linked to a traffic problem. If the road user requests the information too late, the traffic conditions may trap the road user. Therefore, there is a contradiction between the requirements of the traffic server and the road users. In a sense, there is no correlation between them with respect to their own actions, their knowledge and current geographical positions and needs.

The decision point location relative to a location of an accident or incident depends for example on topological factors, i.e. how many side roads exist between a current position of a car and the location of an accident or incident. This dependency may also be dependent on direction of approach towards an accident or incident. For example, if an accident happens at the outskirt of a town there will probably be more alternative roads available if one comes from the city centre compared with coming from the countryside outside the city perimeter. Further, traffic regulations like one-way roads etc. may also influence the number of available alternative routes around an impact area. Therefore, the decision point location relative to the location of an accident or incident may be located at a completely different distance than the perimeter of the impact area as such. The main parameter deciding a location of a decision point is that there must be available side roads with acceptable traffic conditions between the location of a decision point and a traffic incident or traffic event. However, in view of the dynamic behaviour of the impact magnitude and impact area size the location of a decision point is also dynamically changed and correlated with the time dependent evolution of the impact area magnitude and impact area size.

There is also another time dependent problem related to updates of information in traffic servers. For example, authorities like the police, fire brigade, hospitals, road authorities etc. can report accidents. When a car accident happens someone is calling an emergency number and police, ambulance etc. is arriving at the location of an accident. When a police car for example is arriving, an experienced police officer can assess the degree of seriousness of the accident, i.e. impact factor magnitude. However, the time between an accident and the reporting and eventual update of a navigation map for example about the incident will take some time. Even during 10 minutes delay, several hundred cars may be jammed creating a queue that may block side roads as well. The consequence will start to grow both in impact magnitude and impact area size. One interesting aspect of the phenomena is that trapped people in a queue do not know or understand always why there is a queue. Indeed, it is very seldom a need of informing about why there is a traffic problem. The only valid information that is of interest is traffic problems head of you when continuing travelling in the current direction. This is relevant information. The next valid action of a system is then to tell you how to drive to avoid possible problems ahead of you.

Even when notifying a traffic server about an incident quickly, there is no incentive among police officers, first aid personal etc. to update the traffic server with progress information since they are probably busy with the incident itself, i.e. doing their work. Maybe update of status of the incident will happen when the situation or incident is over, or when they submit their report about the situation to their own organisation. During this time, the impact area may grow or other incidents in a same area may worsen the situation without reporting the other incidents.

Therefore, bad road conditions provoked by a local incident can grow in impact area size, and in the periphery of this impact area there will probably be new incidents due to a queue for example that no one at the scene knows originally was provoked by the local incident. Therefore, linking information and guidance around incidents in the periphery of an impact area to an evolution of the original local incident that provoked the problem is not necessary. A queue like this can continue to exist for a long time after the original incident that provoked the queue is over as known in the prior art. This should be reflected in the information and guidance provided to road users around incident points in the periphery of an impact area.

The server may have a system assessing road conditions based on accident and/or incidents. However, the quality of any advice or guidance being the result of the assessment is dependent on the current situation or impact of any accident or incident. Any road user needs advice and alternatives related to the point in time the road user actually asks for an advice. Therefore, it is a road user's geographical position and point in time of arrival to a geographical position that should activate updates of information and analysis, calculations of traffic flow algorithms etc. related to an area around the geographical position of the road user. Linking the information and guidance to a forecast of coming road conditions in the near future relative to the current position in time and location, and direction of travel, and/or due to the road user's selection of destination etc. is preferable.

Besides the time dependencies discussed above, also another factor can make decisions by for example a navigation terminal obsolete. This is changing road user behaviour. Even if a road user has entered a destination into a navigation terminal, the road user can decide at any time to deviate from the calculated route. He can suddenly decide to depart from the route to visit a friend, or he receives a phone call that makes it necessary to cancel the trip but does not delete the selected destination from the navigation tool. Further, road users do not have to enter a destination every time a car is used. If a road user is travelling to his workplace from home (or from the workplace to his home), he will probably not use a navigation tool at all. If an accident or incident blocks or slows down his travel to the workplace (or home) the road user will probably know many alternative routes himself, but the question that is remaining is if his choices are valid choices with respect to traffic flow conditions. The road user would still need information and guidance to qualify if a specific choice he knows or want to use is an open route to his workplace (or home), or that has an acceptable traffic flow density or not.

Therefore, a proper traffic information and guidance system rely on gathering static and nonstatic information about traffic conditions. The system must measure time dependent developments of accidents etc. with respect to impact on traffic flow and size of an impact area. The system must also be able to base guidance about road conditions to specific road users on a rather complex metric that is changing with time and location, and user behaviour of road users defining and qualifying what is an optimal route from a specific geographical location to another specific geographical location. Such guidance should be available even if a traffic information and guidance server system do not know an identity of a road user, and even when not knowing the intended destination of travel of a specific road user. When such a specific road user is in need of an advice or guidance on a specific location, the traffic and guidance server system must provide targeted and relevant information to a road user that in principle can be unknown to the system.

In prior art it is known how a computer server system may have models of maps of road systems, and a traffic server can monitor GPS positions received from GPS transceivers located in cars, or via mobile phones equipped with GPS transceivers and which are carried by road users. Then it is possible to track road user positions on modelled maps, and recording information about accidents or incidents, and the server may issue warnings to approaching road users approaching such locations. However, as discussed above, the warning may not be relevant to the road user since the road user had in mind to turn off the road that would be problematic for the travel anyhow. The new road followed by the road user may have an entirely different traffic problem that still could be a real hindrance for the continued travel. For example, a truck may have capsized and the truck and goods are blocking the road completely. Therefore, the problem is how to warn road users when one really do not know the expected behaviour of the road user. Therefore, broadcast of accidents or incidents to road users even inside a limited geographical area may not provide a solution to traffic flow problems in the area. It is important to bear in mind that when a broadcast warning is received it is most probable that most road users selects another route that is the obvious choice among the alternatives, i.e. is a main road around the problematic area etc. Then it is probable that traffic congestion can build up on the road that is the obvious choice to avoid the initial incident. Road users that do not cooperate will create problems for each other. Therefore, individual guidance from a server may also enable the server to distribute traffic load on several roads and thereby mitigate problems arising from a same advice to everyone. Further, it is rather obvious that broadcasting an advice or information makes it impossible to reach a Nash equilibrium, for example.

Further, in the example above the road user must interpret broadcasted warnings and make an assessment if a warning is relevant for the intended continued travel. In reality, this will be a task of every road user within an area. Road users must think about all the parameters discussed above when evaluating the impact of an incident or accident on selectable routes of an intended continued travel.

In prior art it is a growing trend in the auto industry to equip cars with wireless Internet facilities. In this manner there is a growing availability of a technical infrastructure that is standardized (and not proprietary), and which is common knowledge among most road users. Therefore, informing road users about traffic conditions, and even providing intelligent guidance from for example authorities over the Internet connected to wireless terminals can therefore mitigate problematic road conditions like queues etc. Tuning and operating traffic lights may speed up traffic flow in cities during rush hours. Information about respective road conditions like traffic accidents or incidents can then also help road users to select other routes, and in combination with central traffic light control such problems may not turn into hour-long queues during rush hours.

A standard Internet service is a WEB page that for example can provide the information and guidance referenced above. Segmenting such pages according to geographical areas, certain parts of a city etc. is common. When driving a car it is usually difficult for the driver to operate a wireless terminal searching for information while at the same time keeping track of other road users. Therefore, accessing such WEB pages are usually beneficial before a ride starts and the information of interest is usually of a nature that is more general. The information can include information for example about ongoing roadwork, expected weather conditions like fog conditions the next coming hours, snow conditions etc., or about major accidents, fires etc. that has been reported, but which may not be reported that it is all over.

Alternatively, or as a supplement to Internet based services, vehicle-to-vehicle networks wherein the object is to communicate to others for example if a driver is pushing the brakes of his car may be used. Submitting information about road conditions, in addition to a warning of braking the car etc., submitted over the vehicle-to-vehicle networks to cars behind the braking car is possible, and then this can trigger the cars behind to slow down immediately. A vehicle-to-vehicle network can have an interface node to standard Internet services, which makes it possible to access the network between cars from external servers via Internet protocols.

It is known in prior art to use push messages when operating a traffic information and guidance server system. A push message in this context is a message sent from a traffic server to an individual road user, or a group of road users without the need for any road user to request the message. In prior art it is known to utilize a technique denoted geofence to be able to achieve an automatic broad cast messaging system that is distributing messages to mobile users crossing a virtual defined geographical perimeter around a Point Of Interest (POI). However, since anyone that is crossing the geofence usually receives the same information there is no targeting of the information with respect to specific road users. The information will probably not provide any specific relevant guidance for a specific road user, but only be of general interest to the majority of road users crossing the geofence from any side of the geofence around the POI. Again, it may be a problem, as discussed above, that a same warning or information of an accident, or incident, or a queue or any traffic related problem etc. is triggering a collective choice of selecting a same alternative route. The alternative rout may be the obvious choice to follow around problematic areas.

The example of a geofence above enables a server to identity the approximate geographical position a road user is located on, and the server can for example track or follow the movements of the road user to a next POI. This recorded movement can then qualify targeted traffic information to this specific user. However, it may be a legal issue if a traffic server can follow movements of a road user without the road user's explicit consent to do so. Further, why should a server record all movements of all cars in a city? Besides being a probable legal issue the technical challenge of tracking positions of millions of cars can be a problem, at least a technical problem if the solution needs to be scalable, which may be a necessary condition for example during rush hours. Further, broadcasting of information is an incentive to collective behaviour of road users, which probably create new traffic problems.

US 2002/0065599 A1 disclose a traffic management system (TMSYS), which comprises a road network (RDN) on a physical layer (PL) and at least a packet switched control network (PSCN) on a traffic control layer (TCL). The vehicle traffic formed on the physical layer (PL) by a plurality of vehicles (C1-Cx) travelling along a plurality of road sections (RDS1-RDSm) of the road network is mapped into a packet traffic constituted by a plurality of packets (CP1-CPx) routed along a plurality of packet routing links. Packet control units (PCU1-PCUn) of the packet switched control network (PSCN) are adapted to control the packets (CP1-CPx) on a respective packet routing link (PRL1-PRLn) in the traffic control layer (TCL) to correspond to or simulate a respective vehicle (C1-Cx) on a corresponding road section on the physical layer (PL). The traffic management system (TMSYS) thus treats each vehicle as a packet and can monitor, control or simulate the traffic on this physical layer (PL) by the packet traffic in the traffic control layer (TCL).

US 2011/0246594 A1 disclose a commuter group service (CGS) which allow commuters to join commuter groups enabling them to socialize while commuting. Through the commuter groups, the users may share commuting routes, traffic updates, road conditions, and other information. Group members may arrange car pools, short term riding arrangements, and may contact each other. The CGS may collect information about respective group member positions, e.g. GPS coordinates, enabling the CGS to calculate traffic conditions and to select location specific information for group members. The system may include an on-line service accessible through a computer or wireless networking device. The user may log into the CGS, create or modify a user profile, and join groups of their choosing. Groups may be associated with specific events or with getting to/from work. Forming commuter groups for commuters that use private vehicles and/or public transportation is possible.

US 2003/0018428 A1 disclose a vehicle information system, which includes an in-vehicle system and a centralized server system. The in-vehicle system communicates with the server system using a wireless communication link, such as over a cellular telephone system. In one version of the system, an operator specifies a destination to an in-vehicle system, which validates the destination. The in-vehicle system transmits specification of the destination to a server system at the centralized server. The server system computes a route to the destination and transmits the computed route to the in-vehicle system. The in-vehicle system guides the operator along the route. If the in-vehicle system detects that the vehicle has deviated from the planned route, it reroute a new route to the destination using an in-vehicle map database.

US US 2008/0234921 A1 disclose a navigation device helping road users when there is a traffic congestion. The device receives real time data about slow traffic flow or low average traffic speed as an indication of a congestion. The device calculates an alternative rout by taking into account historical data about speed conditions on secondary roads weighted with the current average speed in the congestion area.

The prior art publication WO 2012122448 A1 by Lorenz Riegger et al, disclose an agricultural vehicle tracking server system that configures a moving geofence (16) about the location of a vehicle (10). A moving geofence (16) may intercept a point of interest, such as another moving geofence (16), and the server will issue an alert. The particular characteristics of the moving geofence (16) is generating the geofence in accordance with a predetermined scheme. Alerts may be weather alerts, or there can be detection of a situation where two respective geofences around two vehicles are overlapping thereby indicating a possible collision hazard. However, the teaching is about predefined actions like collision detection or weather warnings. There is no targeted information and guidance to a specific road user or road users in general. Any road user crossing a geofence around a same POI gets the same information or warning.

U.S. Pat. No. 8,306,556A by Yi-Chung Chao et al, disclose a system based on real time data. A method of operating an intelligent real-time distributed traffic sampling and navigation system includes: receiving navigation information from a client (a navigation terminal), and analysing the navigation information thereby providing traffic information, and generating a travel route based on the analysis of the navigation information; and sending the travel route to a display in communication with the client.

The international patent application PCT/EP2014/051406 with the title "A traffic surveillance and guidance system" by the same inventor as the present invention, disclose a traffic information and guidance system providing a communication channel between road users driving their respective cars. Each driver has a field of view and the basic concept is that it is possible to combine the field of views of a plurality of road users, or just between two drivers driving for example on a same road. FIG. 1 illustrates schematically a combined field or union of fields of view between a road user in car A with a field of view 1, field of view 2 of a road user in car B and a field of view 3 of a road user in car C. In this manner road users can share information that one road user can view visually while other road users may have problems with visual contact of the situation, for example because of a hilltop, a house, trees etc. Some of the technical features of the invention enabling this concept are that each road user registers himself as a member and user of a server system providing for example traffic information services. When registering, a road user selects a specific geometrical shape and size representing a model of his intended field of view, for example a circle of 500 meters diameter (or any other shape and/or dimension). The traffic server tracks geographical positions using the Global Positioning System (GPS) coordinates of cars or of mobile terminals associated with the registered road users. One important aspect of this method is the relative movement among the road users, which are establishing the union and the communication, as well as closing the communication among them when they move apart. Then the road users in a union are all relevant for each other enabling them to communicate information from the same geographical area. This invention helps and promotes road users to cooperate when for example one member of a union spots an incident and sends a message about the incident within the union. Then it is possible to achieve Nash equilibrium locally for the members of the union. In addition, the traffic server may intervene and provide specific advices to the members of the union. If not dissolving a union when road users travel away from each other, achieving Nash equilibrium can never be possible among these road users since the messages starts to be invalid information for the road users still traveling within the relevant geographical area when they receive information from members moving further and further away. This scenario is common among commuter group systems, which often allows people to stay in contact regardless of relative position between commuter members.

Even though the teaching of PCT/EP2014/051406 do provide a significant contribution to the art with the concept of unions, the traffic information and guidance system according to the present invention enables information and guidance services to road users within unions that originate from traffic conditions outside the respective unions. In a sense, the traffic server may intervene and provide qualified advice and information to a union as an added information or as an alternative to observations of members of the union of a specific traffic condition in the union. For example, when avoiding development of severe traffic conditions it may be necessary to update information from a larger geographical area outside the area covered by a union. The union is a superb tool when warning and informing other road users instantly within a limited neighbourhood. However, effects of time dependent evolution of incidents like impact factor magnitude and impact area size etc. is outside the scope of a union since a union probably moves away from a fixed geographical position of an incident, or individual and relative movements of road users away from each other dissolves the union. The present invention is about individual road users and/or unions approaching geographical areas that might have traffic problems causing traffic flow problems for the road users before they come in contact (or union) with closely located road users having information about the specific problem.

On the other hand, a road user listening or using information from a traffic information server usually only need information related to a neighbourhood of his current position at a specific point in time of arrival to the neighbourhood. However, the intended rout that a road user will follow leaving his current position may be unknown to the traffic server (or other members of a union). A traffic server can independently acquire information and traffic measurements online all the time. However, as long as a road user can have independent and random behaviour in the traffic the traffic server may have problems providing specific information and advice that will be relevant for the specific road user. In a sense, the traffic server and a road user are operating individually and without any form of cooperation in the traffic.

According to an aspect of the present invention, solving this and other problems is possible through a system and method thereof, informing and guiding road users approaching junctions. The information can be about traffic flow conditions on roads leading in and out of the junctions. Advices can be how to drive to avoid traffic problems in forward located areas having roads in common with roads leading out of the junctions. Thereby, on the time of arrival in front of the junction, the road user is informed. If a road or street the road user intended to follow when passing the junction have problematic traffic flow conditions, the road user can select another road out of the junction having less traffic problems. Thereby, the junction serves as a decision point for an approaching road user.

Therefore, an improved road traffic information and guidance system would be advantageous, and in particular, a more targeted and/or relevant information and guidance of road users would be advantageous.

OBJECT OF THE INVENTION

In particular, an object of the present invention is to provide a traffic information and guidance server system that solves the problems mentioned above of the prior art by configuring a method and system executing method steps providing distribution of traffic information and guidance about traffic incidents or events in geographical areas correlated with road user approaches towards the junctions, wherein the information and guidance is related to traffic incidents or events in the geographical area surrounding the respective junctions.

It is a further object of the present invention to provide an alternative to the prior art.

SUMMARY

Thus, the above-described object and several other objects are intended to be obtained in a first aspect of the invention by providing a computer implemented method of wireless distribution of traffic related messages and guidance to road users having mobile terminals travelling on a road system being monitored by a traffic server, wherein the traffic server is configured with a computer-coded map of a geographical area comprising the road system, and the server is further configured with steps of:

allocating virtual traffic guides in a plurality of junctions being represented in the computer coded map of the road system, associating all road names, or similar road identifications, leading in and out of the respective junctions associated with virtual traffic guides, and maintaining and updating a record of traffic flow levels on inbound and outbound traffic lanes of roads relative to each one of the virtual traffic guides, the traffic server is configured to acquire on a regular basis, or on an event driven basis, reports or information regarding traffic related incidents or events on the monitored road system, when the traffic server is analysing a specific report or information regarding a specific traffic incident or event, the traffic server is designating virtual traffic guides as decision points in the computer coded map at junctions having roads in common with roads in a geographical area surrounding an identified geographical location of the traffic incident or event, wherein the decision points are surrounding the geographical location of the incident or event, in a distance from the incident or event being assessed by the traffic server as defining an initial impact area size of the incident or event, evaluating the recorded and updated traffic flow levels of the named roads in and out of the respective decision points, and each decision point is designated as an open or closed decision point according to a result of the evaluation the traffic levels, wherein:

a decision point is designated as an open decision point if at least one inbound traffic lane relative to the decision point of a first named road is having a traffic flow level above a first predefined threshold level, and at least one outbound traffic lane relative to the decision point of a second named road is having a traffic flow level above a predefined second threshold level, thereby there is at least one road connection through the associated junction that has an acceptable traffic flow condition, a decision point is designated as a closed decision point if none of the roads of a decision point have a traffic flow level above the predefined threshold levels, or just one lane of a road have a traffic flow level above the predefined threshold levels, and designating virtual traffic guides having the named roads in common with the closed decision point(s) as candidates for being an open decision point, wherein candidate decision points are designated as open or closed decision points after an outcome of an analysis of the traffic flow levels of roads associated with the respective candidate decision points, when a candidate decision point is a closed decision point, then continuing evaluating further candidate decision points located away from the closed candidate decision point away from the geographical location of the traffic incident or event, until an open decision point is identified, thereby an impact area around a reported traffic incident or event is bounded by open decision points around a periphery of the impact area, and when a road user is detected to be approaching an impact area by the traffic server, the traffic server detects which open decision point the road user is approaching, the traffic server then informs the approaching road user about the at least one road connection with an acceptable traffic flow level through the associated junction of the open decision point the road user is approaching, thereby the road user can avoid entering the impact area of the traffic incident or event.

FIGURES

The road traffic information and guidance server system according to the present invention is disclosed in more detail with reference to the accompanying figures. The figures illustrating examples of embodiments of the present invention is not to be construed as being limiting to other possible embodiments falling within the scope of the attached claim set. Further, respective features of examples of embodiments may each be combined with any of the other features of examples of embodiment.

FIG. 7 illustrates an example of standardised traffic messages.

DETAILED DESCRIPTION

Traffic information and guidance server systems usually have a standard client/server data model as the basic building block when distributing information to road users. A mobile telephone network with an added Internet protocol on top of a wireless communication infrastructure provides a standardised and known technical communication solution for client/server architectures as known to a person skilled in the art. Some modern cars are also equipped with large touch sensitive display screens (like Tesla Model S) providing an interactive graphical interface between client and traffic server and a road user driving the car.

Figure 1:
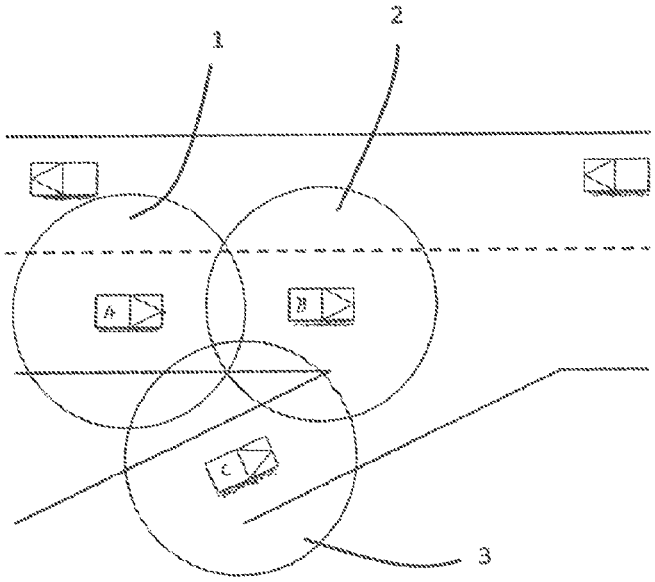
FIG. 1 illustrates an example of prior art.
Figure 2:
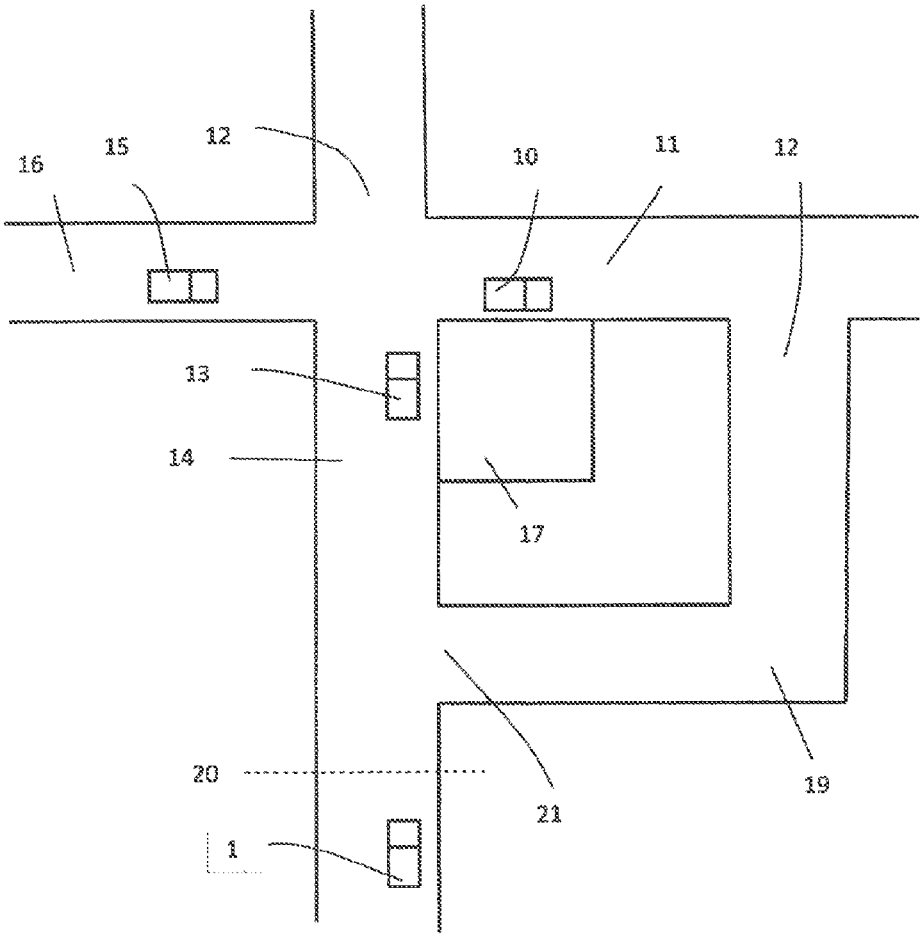
FIG. 2 illustrates an example of a traffic situation around junctions.

With reference to FIG. 2, a car 10 has experienced a motor stop and is blocking the road on a road segment 11 close to a junction 12. A car 13 approaching the junction 12 on another road segment 14 cannot see that car 10 is blocking the road segment 11 because it is located around a corner of a house 17. The car 15 on the road segment 16 is however in visual contact with car 10 and can understand the situation. With reference to the teaching of PCT/EP2014/051406, forming a union between car 13 and car 15 is possible. Then the road user in car 15 can send a message in the union giving a warning about the incident that just happened to the road user in car 13 since the road user in car 15 has unobstructed visual contact with car 10 and can spot the situation visually. If the road user in car 13 had in mind to turn into the road segment 11 he could end up with a delay in his travel since the car 10 is blocking the road. How long the car will remain in the blocking position is uncertain. It is important to note that the car 10 does not need to be in a union with car 15 and/or car 13. However, car 10 can be a member of a union with other cars (like car 13 and car 15) and the road user of car 10 would of course be able to send a message within the union with a warning about the situation. If car 10 is a member of a traffic server system and the driver of car 10 is unharmed in spite of the incident, the driver can notify the traffic server directly about the incident. If car 10 is not a member, or incapacitated to report the incident, car 15 that have unobstructed visual contact of the situation will do the reporting in the union between car 15 and car 13. The traffic server system is listening to all communications within a union. The traffic server can then register the incident. Deduction of an approximate geographical location of car 10 may be derivable from the content of the messages sent at respective geographical positions of car 15 and car 13, or by the signalling between mobile terminals of the user and for example base stations of a mobile network.

After a while, both car 15 and car 13 would move away from the situation with car 10, for example by following alternative routes. Car 15 could turn left or right in the junction 12, and car 13 could decide to continue straight ahead. The respective road users can identify these alternatives visually by themselves as valid choices enabling them to avoid an unwanted stop due to the stopped car 10.

Meanwhile, a car 18 can approach the junction 12 without having visual contact with the situation on the road segment 11. Since car 15 and 13 now may have moved further away from the incident with car 10, car 18 would probably not form a union with either car 13 and/or car 15. However, the traffic server system can inform the road user in car 18 about the incident since the traffic server have received information about the incident as discussed above via the communication in the union. If car 18 gets this warning before the car 18 reaches junction 21 the road user in car 18 could turn right onto road segment 19 and be able to reach the road segment 11 via the junction 22 located on road segment 11 away from the stopped car 10.

Different choices of routes for travel on the roads connected by the three junctions 12, 21, 22 in the example depicted in FIG. 2 is possible. However, the stopped car 10 on the road segment 11 may affect a specific choice of rout. When car 10 experienced the incident and blocked the road segment 11 it may take some time before a number of cars will arrive at the scene and maybe will have trouble in traversing the road segment 11 when passing car 10. In this situation, a queue of cars could start to build up on road segment 11 and stretch passed the junction 22. In this situation an advice of letting car 18 turn right onto road segment 19 in junction 21 to reach junction 22 and then onto road segment 11 away from the stopped car 10 would be a dubious advice. The queue stretching passed the junction 22 may block car 18 from entering the road segment 11. In a sense, this situation created another incident, i.e. a queue in junction 22 that can disappear, or continue to be present, or even start to grow. This is independent of a situation when removing car 10 or car 10 is starting to function again.

The example illustrates a dilemma related to timing of events. The advice above is a valid advice until a point in time where the queue stretching passed junction 22 starts to grow. Therefore, early detection of the impact magnitude (blocking the road in this example) and impact area size (which can end up over time to be the area encompassing all three junctions) are essential parameters to qualify an advice. For example, if car 18 wants to avoid the stopped car 10 on road segment 11 it is not a simple task to predict when car 18 will reach junction 21, and in addition estimate the travel time along the road up to junction 22. The road user driving the car 18 can stop the car, or can speed up or slow down the speed of the car at any time on his own desire. During this uncertain time, the queue may start to build up and block junction 22.

Therefore, the advice can only be a valid advice if providing the advice at a point in time when car 16 reaches a geographical position in front of junction 21 in the travel direction of car 18, for example at the line 20 in FIG. 2. However, before selecting a route to the right in junction 21 towards junction 22 the road user in car 18 needs information about the instant current traffic flow condition on the road segment 11. Further, a forecast of how the traffic flow probably will develop during the time used by car 18 to reach junction 22 on the road to the right from junction 21.

This simple example illustrates the complexity of providing accurate and specific advice to a road user.

The problem may be simpler to analyse and handle by the traffic server if notifying the traffic server about a planned destination of car 18. The notification should also specify traversing road segment 11 before calculating a route towards the specific destination. Then the traffic server can follow the route and collect information submitted by for example authorities and other road users related to road segments of this route. However, even knowing the destination in this example, the time dependencies of accidents or incidents or other types of sudden traffic related problems etc. is not part of this model. Even if the traffic server system can calculate traffic forecasts with the help of advanced mathematical models, the forecasts will probably be of general nature and not specific for individual points in time. Forecasts are more like average conditions over longer time spans, and more specifically, they cannot handle an incident as described with car 10. No mathematical model or forecast can predict that car 10 would stop as it did at a specific point in time. If the road user has not revealed his destination to a system, he would still need the same essential advice as discussed above if his intention were traveling to the same destination via road segment 11. Further, if the road user in car 18 has no intension of traversing road segment 11 at all, any advice or warnings about traffic conditions at junction 22 would be of no significance to the road user at all. In a sense, there is no difference if the traffic server knows the destination or not.

According to an aspect of the present invention, traffic information and guidance of road users are more adequate when provided to road users when they approaches junctions rather than informing or guiding the road users when they are traversing roads or streets between junctions, i.e. on the road between junctions. The reason is that advising a road user to select another road than first intended by the road user is not possible if he already is on a specific road. Junctions may provide instant access to alternative routes.

Applying this aspect is possible even if a road user has selected a destination in a navigation tool. The road user must by default passing specific junctions due to the selected roads by the navigation tool, and the calculated route indicates which junction is the next junction the road user will pass. If no problems on the road segment from the current junction to the next junction exists, the road user can continue on the planned rout. If there is a problem for example due to an incident on this road segment the traffic server will provide an advice to select one of the other roads as an alternative which can lead the road user towards his destination after a rerouting including this alternative road. Due to the problem of evolution over time of respective traffic conditions, accidents, incidents etc. the validity of any advice is usually limited in time as discussed above. Therefore, the traffic server again should detect this approach and based on the time of arrival make a new fresh assessment of traffic condition on a next road segment to the next junction the road user will pass, even if this means a continued deviation from a planned route.

The traffic server may advice a road user to use a road with less traffic flow volume than another road in the junction. If the traffic server provides the same advice to a plurality of road users, the road conditions will change and consequently the advice will change to identify yet another road having less traffic problems. The traffic server may look at traffic flow conditions on roads out of junctions having roads in common with the roads out of the current junction.

Then it is possible to provide an advice that will guide a road user out of a larger area with traffic problems onto only roads with less traffic volume.

Therefore, according to an aspect of the present invention, junctions represents possible decision points. If connected roads of the junction have a queue problem, the traffic server may identify when the queue blocks the junction or any road in or out of the junction. A decision point located in a junction that is blocked, or is close to be blocked, is designated as a closed decision point. Traffic conditions can change, and then a closed decision point can change status to an open decision point. When a junction is blocked, the traffic server may move the open decision points to junctions having roads with acceptable traffic flow conditions around a periphery of the junction with problems. Then the traffic server may keep an overview of available roads that have reasonable traffic flow conditions.

Figure 3:
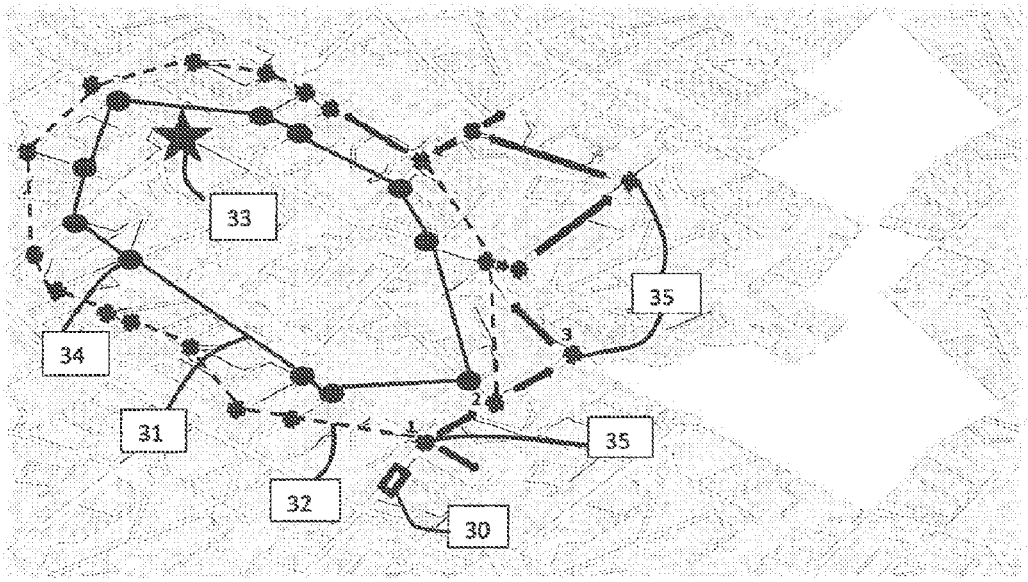
FIG. 3 illustrates an example of a city area with traffic problems.

FIG. 3 illustrate an example of an impact area 31 surrounding a traffic incident or event 33. Around the periphery 31 of the incident 33 there are located virtual traffic guides 34 (illustrated as dots) being designated by the traffic server as closed decision points. These closed decision points restrict the impact area. However, a road leading towards a closed decision point may be possible to drive, but when the driver reaches the closed decision point the driver will experience difficulties passing the closed decision point by definition. Therefore, according to an aspect of the present invention, identifying an open decision point further away from the impact area is possible. In FIG. 3, illustrations of open decision points 35 are with crosses. When a road user in a car 30 is approaching a first open decision point 35, then the open decision point provides an advice to the approaching road user to drive in a direction towards a second open decision point 35. Then the second open decision point is advising the road user to drive towards the third open decision point 35, and after a while, as illustrated with the arrows in FIG. 3, the road user has passed the impact area. According to an aspect of the present invention, bounding any geographical area having traffic problems with open decision points mitigates the traffic problems. Then any approaching road user do have available other roads by definition that can lead the road user out of or around the area in question.

Figure 4:
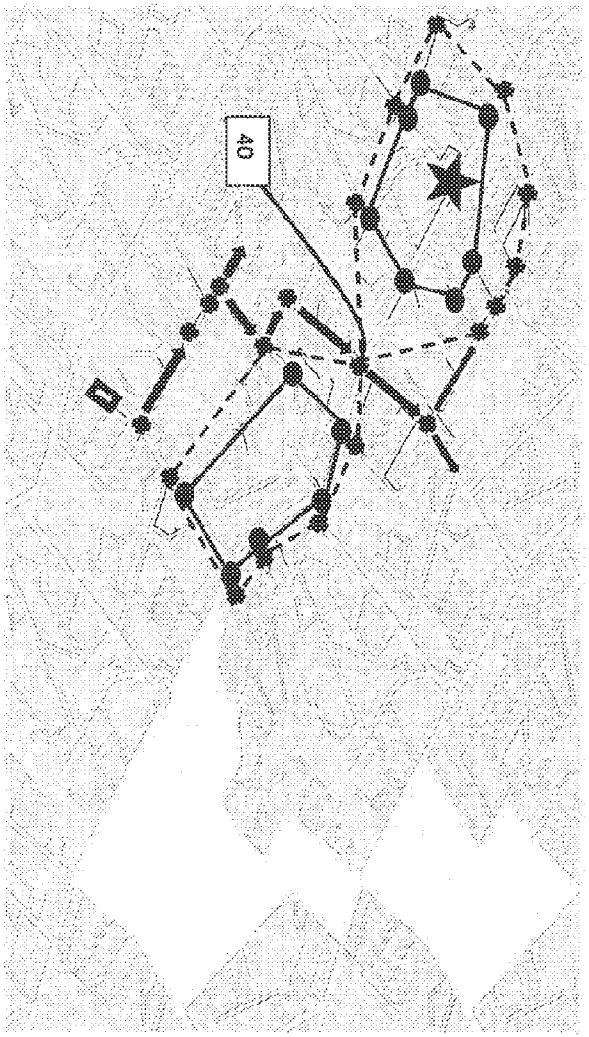
FIG. 4 illustrates another example of a city area with traffic problems.

FIG. 4 illustrates an example of time dependent evolution of the impact area depicted in FIG. 3. A middle section of the original impact area is now split in two separate impact areas, wherein the open decision point 40 is common between the impact areas. The arrows in FIG. 4 illustrate a possible rout around the impact areas via the open decision point 40.

According to an example of embodiment of the present invention, a traffic server is configured with a software program executing steps of a method with the support of a computer-coded model of a map over a road system within a geographical area the traffic server is monitoring. The traffic server is allocating virtual traffic guides in a plurality of junctions being represented in the computer-coded map of the road system. Then names of roads or similar road identifications like road numbers etc. coming in and out of junctions associated with the virtual traffic guides are identified from the computer-coded map of the area. The respective names of roads, or similar identifications, are associated with the respective virtual guides, for example by being registered in a table for each junctions having a virtual guide. Such a table may also have information for example about traffic conditions on the roads. Then the traffic server can maintain and update a record of traffic flow levels on inbound and outbound traffic lanes of roads relative to each one of the virtual traffic guides.

Figure 6:
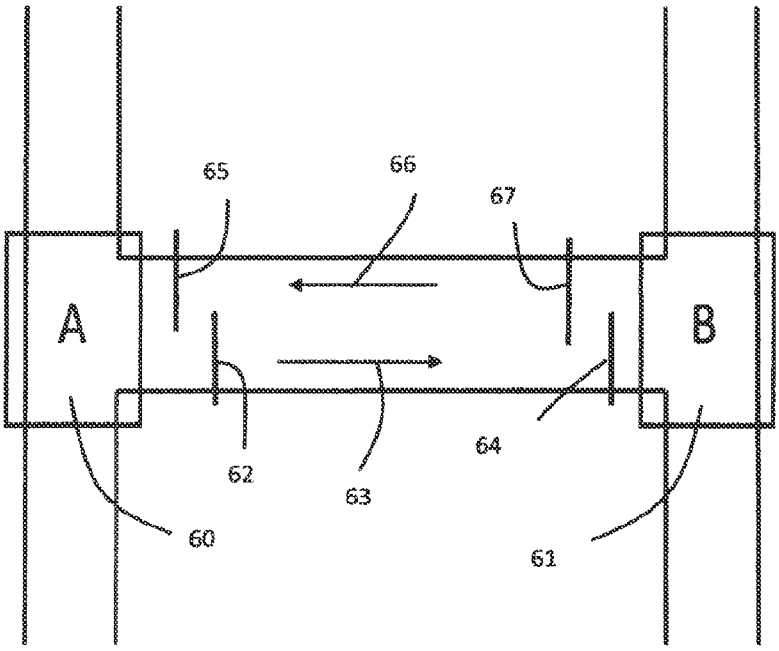
FIG. 6 illustrates an example of embodiment of the present invention.

FIG. 6 illustrates another aspect of the present invention. Two junctions A and B share one common road segment between them. An outbound traffic lane 63 of junction A is an inbound traffic lane seen relative to junction B. The outbound lane 66 is an inbound traffic lane relative to junction A. In front of junction A there is a geofence line 62 across traffic lane 63, and a geofence line 65 across the traffic lane 66. In a similar fashion, there is a geofence line 64 across traffic lane 63 in front of junction B, and a geofence 67 across the traffic lane 66. When a car for example crosses geofence 62, the traffic server can identify the event. According to an example of embodiment of the present invention, each virtual guide or decision points have a register keeping updates of cars entering or leaving a road segment, also with respect to each traffic lane of the road segment. When a car is crossing the geofence 62, the traffic server then knows that a car is leaving the junction A towards junction B on traffic lane 63. When the car crosses the geofence 64, the traffic server knows that the car is leaving the traffic lane 63 in front of junction B. The traffic server can also register a road user identity when updating the respective tables.

An interesting aspect of this example of embodiment is that it is possible to make flux measurements of cars in and out of the named roads. If the flux of cars into a traffic lane is higher than the flux of cars out of the same traffic lane, it is probable that a traffic queue is building up on this traffic lane. By measuring the difference in flux it is also possible to estimate the time left before a congestion manifest itself. If the flux in is much higher than the flux out it is probably just a short time left before the problems starts to be visible. The contrary can also be possible to measure. If the flux out of a traffic lane is higher than the flux in on the traffic lane, and if there have been traffic flow problems on this road segment they are about to be less problematic. When measuring flux differences over time it is possible to make an estimate of the time left before the problems are over.

Information of traffic incidents or events can be acquired by the traffic server from a plurality of sources, for example from road users reporting incidents to the traffic server, or from radio and TV stations having traffic surveillance helicopters reporting traffic situations, authorities like the police, the fire brigade, or emergency agencies, etc. The traffic server can acquire reports or information on a regular basis, i.e. asking around every hour, for example. The traffic server may also act on events, like for example a report about a major incident. Then the traffic guide can be continuously searching for news about the major incident until the situation is over.

Whenever an analysis of acquired reports and information indicates traffic problems in a specific geographical area, the name of the area can be identified from the content of the reports and information. There may be a name being the name of two roads crossing each other in a junction, a name of a neighbourhood etc. If a road user is submitting a message about an incident or event, the GPS position of the road user can be used in a reverse look up process in the computer coded map of the area, as known in prior art, when identifying a name of the location.

The server can then start analysing the traffic conditions on road around the reported incident or event. The analysis may also optionally include allocating virtual helpers being located in roads leading in and out of junctions. The virtual helpers can issue questioners to road users that are detected to be approaching a virtual helper. The response to the questions can then be part of the process of estimating traffic flow levels of the roads in and out of junctions.

Then the traffic server starts a process of identifying virtual traffic guides that are designated either as open decision points, or as closed decision points.

The geographical position of a traffic incident or event is a starting point when identifying an impact area around the incident or event. There are many methods available to make such an evaluation of a size of an initial impact area. For example, in FIG. 7 there is illustrated an example of standardized traffic messages according to the RDS TMC standard that are identified by a code number. Such standards are used by many traffic surveillance systems. Then the text associated with the code can easily be available in any language. In the FIG. 7, English and Norwegian text of same messages are listed. For example, if the report acquired by the traffic server is message number 216 the report is about an accident that has created a queue of about one kilometer. Then the initial size of the impact area can be a circle with a radius of about one kilometer. Alternatively, speed measurements of cars around in the area can provide a speed profile indicating where problems starts (slow speed) and where they end (normal speed), i.e. indicating the size of the impact area.

The traffic server can then identify virtual traffic guides being approximately located on the initial circle and designate these as decision points if the junctions have roads in common with roads in the area around the accident. The traffic server then identifies open and closed decision points by executing the following examples of method steps:

evaluating the recorded and updated traffic flow levels of the named roads in and out of the respective decision points, and each decision point is designated as an open or closed decision point according to a result of the evaluation the traffic levels of the named roads, wherein:

a decision point is designated as an open decision point if at least one inbound traffic lane relative to the decision point of a first named road is having a traffic flow level above a first predefined threshold level, and at least one outbound traffic lane relative to the decision point of a second named road is having a traffic flow level above a predefined second threshold level, thereby there is at least one road connection through the associated junction that has an acceptable traffic flow condition, a decision point is designated as a closed decision point if none of the roads of a decision point have a traffic flow level above the predefined threshold levels, or just one lane of a road have a traffic flow level above the predefined threshold levels, and designating virtual traffic guides having the named roads in common with the closed decision point(s) as candidates for being an open decision point, wherein candidate decision points are designated as open or closed decision points after an outcome of an analysis of the traffic flow levels of roads associated with the respective candidate decision points.

The respective different threshold levels do not rule out that they can be equal. However, it is important to bear in mind that roads in and out of a junction can have more than one traffic lane in one direction, hence larger capacity. The threshold levels reflects real traffic flow capacities of traffic lanes. Therefore, tuning the threshold levels during rush hours, for example is possible to adapt the general known historical traffic flow conditions in an area. During rush hours, for example, it is better to designate a road as having an acceptable traffic flow level even when the average speed on the road is low compared to roads with stopped traffic. In rush hours, it can be of interest to utilize all roads that still can move traffic. It is also possible to adapt different threshold levels of individual roads.

The traffic server is also configured to execute a step of assigning a one-way street being common between two virtual traffic guides with a traffic flow level of zero in a driving direction opposite the one-way road direction.

The traffic server is further configured in an example of embodiment with method steps of assigning respective roads as closed or open roads, for example as part of tables having listed the names of roads in and out of the junctions associated with virtual traffic guides, as discussed above. This can further simplify the evaluation of traffic flow conditions when assessing if a decision point is an open or closed decision point.

It is also possible to make consistency checks of traffic flow conditions on roads since there is usually a junction in both ends of a road. Therefore, in an example of embodiment of the present invention, the traffic server may investigate the status recorded in the virtual traffic guides in both ends of a road, and if there is a conflict between the status of the road, change the status to closed in both ends.

Further, if there is only one outbound traffic lane with an acceptable traffic flow level associated with a first decision point, then identify if the outbound lane is on a named one-way road from the first decision point to a second decision point having the named one-way road in common, and then identify if the second decision point have at least one other outbound traffic lane with an acceptable traffic flow level, then designating the first decision point as an open decision point, otherwise, the first decision point is designated as closed.

Further, if there is only one outbound traffic lane with an acceptable traffic flow level associated with a first decision point, then identify if the outbound lane has a traffic flow different from the traffic flow level of the inbound lane of a second decision point having the named road in common, and then identify if the second decision point have at least one other outbound traffic lane with an acceptable traffic flow level, then designating the first decision point as an open decision point if the difference of the respective traffic flow levels is below a predefined threshold level, otherwise, the first decision point is designated as closed.

It is also a possibility to denote a status of a dead end road as closed. Further, any driving advice provide for by the traffic server will inform approaching rod users about closed roads.

The virtual helpers discussed above can for example, refer FIG. 2, be allocated as helpers to virtual traffic guides centred in all junctions 12, 21, and 22 in the computer-coded map of the area covering these junctions. The virtual traffic guides can have a "guide field" stretching into each respective road connected by the respective junctions. On the other hand the road user may have defined a corresponding "guide field" which also can stretch out a certain adjustable distance in front of the car. When a union between these fields is established, as disclosed in PCT/EP2014/051406, information from the traffic guide to the road user is transmitted. Then the road user can use his own experience tuning his own needed reaction time by enlarging or decreasing his guide field by adjusting the size of the field in his user profile in the traffic server.

The virtual helper may then issue questions to road users coming in a union with the virtual helper when passing the accident or incident. The questions can be submitted for example to Internet connected terminals in the cars in the union from the traffic server, but due to road safety regulations the road users should not start to write a text as the answer to these questions. The answers should be "yes" or "no" or just a number to identify an impression of the situation. The point is to let the virtual helper identify how passing road users experience the impact magnitude of an incident or accident. When doing this over time the traffic server will be able to assess impact magnitude of the incident or accident. At the same time, the virtual helper can measure time displacement of selected GPS positions (i.e. cars) and can then calculate speed conditions at the location. If there is a stop in movement of cars, the virtual helper can for example issue a question like "I observe that you have stopped the car. How serious do you think the accident is on a scale from 0 to 9, nine being the most serious kind of incident"? When the virtual helper receive a plurality of answers, the statistical validity of the answer is improved as known in prior art.

Dependent on the average speed of cars passing the incident or accident etc. the traffic server can follow how the speed of cars develops when approaching the accident or incident etc. The virtual helper can estimate the impact magnitude since the average speed will reflect the magnitude of the impact when measuring speed degradations over a larger area. If the speed is even and close to allowed speed limits, the magnitude of the impact of the incident is low. This is in contrast to a situation with full stop of cars. When following a trend in speed degradation over a larger area, the traffic sever can identify a limit of the impact area. Asking similar questions is possible and corresponding analysis are within the scope of the present invention. For example:

"We register that your speed is low. Are you in a queue?"

"What is the reason for the queue? Select one of the following symbols."

"We register that your speed has increased. Is the queue over?"

An important aspect of the questioner is to adapt questions to standardized RDS TMS messages, for example like the messages disclosed in FIG. 7. Then it is possible to provide a consistent analysis of traffic incidents and events.

There exists also other standardization efforts. For example, US department of Transportation has developed a standardized terminology when describing incidents or accidents in the traffic. The work is a cooperation between interested parties in a coalition denoted NTIMC (National Traffic Incident Coalition). The purpose is to enable traffic incident responders to use plain English, but still provide an accurate report with details for example of which lane of a highway the accident has occurred. The standard is necessary to be able to refer to lane number 1 without making a confusion if it is the leftmost or the rightmost lane that is lane number one, for example. The outcome of this standard is that it is possible to interpret text messages consistently, even for a software program in a traffic server searching for standardized keywords.

Figure 5:
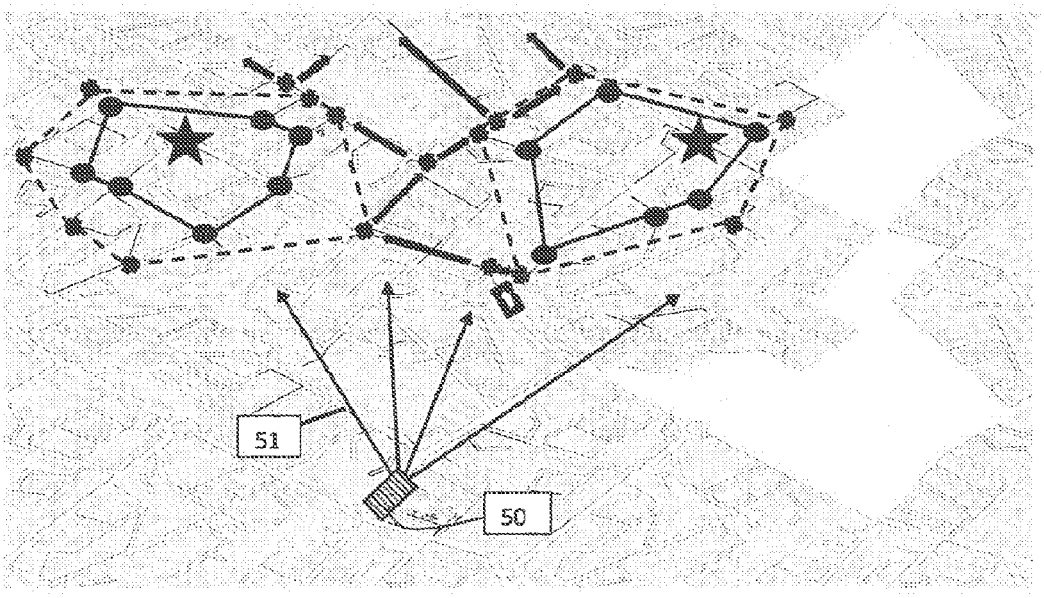
FIG. 5 illustrates an example of embodiment of the present invention.

A further aspect of the method according to the present invention is that the method do not support a request for a specific traffic forecast for a specific rout from a user as such. However, with reference to FIG. 5, a radio program the road user 50 is listening to can inform the road user of traffic congestions in areas in front of him. The problem is that he does not know the extent of these problems. The question is what the effect is if he continue travelling in his present direction. According to an example of embodiment of the present invention, the road user 50 can send out a plurality of virtual cars that the traffic server will detect is approaching decision points, and then the road user can receive back information about location of open decision points. This may help him plan a rout ahead with minimum traffic problems. Further, the plurality of virtual cars can iterate between many different possible combinations of roads and junctions to find open roads leading him around the problematic areas. When combining the searching and probing with an optimisation algorithm, for example the known "traveling salesman" algorithm, it is possible to identify an optimised rout around the problems.

According to another example of embodiment of the present invention, a road user driving a car can for example establish a "radar field" around the car that can form unions with virtual traffic guides and virtual helpers of any kind etc. When such unions are formed the road user can establish interactive sessions with each virtual entity thereby receiving updated traffic information and also provide information to the traffic server, for example through answers to questioners. Since a union also enables the traffic server to identify the specific road user, any specific knowledge or preferences the road user have recorded in his user profile may be used to qualify any information or advices sent to the specific road user. For example, it is possible for a road user to limit the information he wants to receive to be weather forecasts and weather warnings only. Further, an advice provided by a virtual traffic guide or decision point can be personal by taking into account historical data indicating the most probable rout the road user is following when passing the associated junction.

Another aspect of virtual traffic guides and virtual helpers being in a union is that messages to specific road users can be submitted from the traffic server to virtual traffic guides or virtual helpers. The server can deliver a message together with a road user identity to a message buffer controlled by a receiving virtual traffic guide or virtual helper at any time. When the specific road user comes in a union the message is delivered, and a company or person that initiated the message can be notified about the delivery. A transport company may need to provide new instructions to company drivers arriving at a specific geographical location. Then it is not necessary to track individual drivers or cars, and messages are delivered at specific geographical positions that can help the transport company in optimizing utility of cargo capacity, for example.

It is also possible to use the aspects of decision points even if one does not know the destination of a road user, i.e. the road user does not enter a destination. While driving the road user may experience some disruption in the traffic conditions around his present position on a road. He can then start to wonder if this is signalling of emerging traffic problems. The road user can then for example draw a line on a touch sensitive display surface of a navigation terminal, or any other terminal or device being in the car for example, indicating the roads he will follow through this specific area he suddenly felt or sensed was starting to have traffic problems. Then the system can select a possible destination in the end of the line in the direction of drawing the line. Then the process of finding open decision points as outlined above with reference to FIG. 5 can be used.

Another aspect of the present invention comprises allocating traffic control functions to virtual guides. In a sense, such a virtual guide can be viewed as a virtual police officer. For example, cooperation between a virtual police officer located in a traffic light controlled junction and virtual helpers located on side roads of the junction makes it possible to measure how traffic volumes build ups in front of the junction on the respective roads. Then the virtual police officer can inform city authorities controlling the traffic lights about difficult situations. Then the total traffic flow can be monitored and specific traffic light settings can mitigate queue problems, for example.

Another example of use of a virtual helper is to allocate virtual helpers at locations of traffic signs. Positions of traffic signs and a code representing the meaning of the traffic sign can be part of a computer model of a map as known in prior art.

When a road user comes in a union with a virtual helper of a traffic sign a graphical image of the traffic sign in front of him can be displayed on a screen in his car. This can mitigate problems related to dark roads or dirt on traffic signs that makes it difficult to read the traffic signs correctly when driving. Sometimes a traffic sign is an information sign that has been put up to advice and inform about road construction work ahead. Such messages can also be transferred via a communication link in a union between the information sign and a road user. Further, it is also possible to submit a WEB link to pages comprising further information and advice about the construction work for example. Sometimes a temporary roadblock of for example a lane can be set up due to sudden problems with the road, for example a broken water pipe, an electric cable has been broken etc.

According to an example of embodiment of the present invention, a traffic server is configured with a computer-coded map of a geographical area comprising a road system, and the server is further configured to execute steps of a method comprising:

allocating virtual traffic guides in a plurality of junctions being represented in the computer coded map of the road system, associating all road names, or similar road identifications, leading in and out of the respective junctions associated with virtual traffic guides, and maintaining and updating a record of traffic flow levels on inbound and outbound traffic lanes of roads relative to each one of the virtual traffic guides, the traffic server is configured to acquire on a regular basis, or on an event driven basis, reports or information regarding traffic related incidents or events on the monitored road system, when the traffic server is analysing a specific report or information regarding a specific traffic incident or event, the traffic server is designating virtual traffic guides as decision points in the computer coded map at junctions having roads in common with roads in a geographical area surrounding an identified geographical location of the traffic incident or event, wherein the decision points are surrounding the geographical location of the incident or event, in a distance from the incident or event being assessed by the traffic server as defining an initial impact area size of the incident or event, evaluating the recorded and updated traffic flow levels of the named roads in and out of the respective decision points, and each decision point is designated as an open or closed decision point according to a result of the evaluation the traffic levels, wherein:

a decision point is designated as an open decision point if at least one inbound traffic lane relative to the decision point of a first named road is having a traffic flow level above a first predefined threshold level, and at least one outbound traffic lane relative to the decision point of a second named road is having a traffic flow level above a predefined second threshold level, thereby there is at least one road connection through the associated junction that has an acceptable traffic flow condition, a decision point is designated as a closed decision point if none of the roads of a decision point have a traffic flow level above the predefined threshold levels, or just one lane of a road have a traffic flow level above the predefined threshold levels, and designating virtual traffic guides having the named roads in common with the closed decision point(s) as candidates for being an open decision point, wherein candidate decision points are designated as open or closed decision points after an outcome of an analysis of the traffic flow levels of roads associated with the respective candidate decision points, when a candidate decision point is a closed decision point, then continuing evaluating further candidate decision points located away from the closed candidate decision point away from the geographical location of the traffic incident or event, until an open decision point is identified, thereby an impact area around a reported traffic incident or event is bounded by open decision points around a periphery of the impact area, and when a road user is detected to be approaching an impact area by the traffic server, the traffic server detects which open decision point the road user is approaching, the traffic server then informs the approaching road user about the at least one road connection with an acceptable traffic flow level through the associated junction of the open decision point the road user is approaching, thereby the road user can avoid entering the impact area of the traffic incident or event.

According to another example of embodiment, which can be combined with the example disclosed above, the traffic server is configured to execute a step of assigning to a one-way street being common between two virtual traffic guides, a traffic flow level of zero in a driving direction opposite the one-way road direction.

According to another example of embodiment, which can be combined with any of the examples disclosed above, the traffic server is further configured to associate an indication of named roads in and out of the virtual traffic guides as open roads if the outcome of the analysis is that the respective traffic flow levels are above the defined threshold levels, otherwise as closed roads.

According to another example of embodiment, which can be combined with any of the examples disclosed above, the traffic server is configures to assign a dead-end road as a closed road.

According to another example of embodiment, which can be combined with any of the examples disclosed above, the respective threshold levels are tuned with respect to overall traffic conditions in a geographical area.

According to another example of embodiment, which can be combined with any of the examples disclosed above, the traffic server is further configured to check conflicting status of a named road by comparing the status recorded in at least two virtual traffic guides having a named road in common, and if there is a conflict of status, resolve the conflict by assigning the named road as a closed road in the at least two virtual traffic guides having the road in common.

According to another example of embodiment, which can be combined with any of the examples disclosed above, the evaluation of the traffic flow levels of named roads associated with respective decision points, or candidate decision points, further comprises the steps of:

if there is only one outbound traffic lane with an acceptable traffic flow level associated with a first decision point, then identify if the outbound lane is on a named one-way road from the first decision point to a second decision point having the named one-way road in common, and then identify if the second decision point have at least one other outbound traffic lane with an acceptable traffic flow level, then designating the first decision point as an open decision point, otherwise, the first decision point is designated as closed.

According to another example of embodiment, which can be combined with any of the examples disclosed above, wherein the evaluation of the traffic flow levels of named roads associated with respective decision points, or candidate decision points, further comprises the steps of:

if there is only one outbound traffic lane with an acceptable traffic flow level associated with a first decision point, then identify if the outbound lane is on a named road from the first decision point to a second decision point having the named road in common, and then identify if the second decision point have registered a traffic flow level being higher or equal than the acceptable traffic flow level of the first decision point, then designating the first decision point as an open decision point, otherwise, the first decision point is designated as closed.

According to another example of embodiment, which can be combined with any of the examples disclosed above, the traffic server is configured to evaluate traffic flow levels of named roads associated with decision points regularly, thereby respectively changing a designation of a specific decision point from open to closed, or from closed to open, dependent on an outcome of the evaluation of the traffic flow levels.

According to another example of embodiment, which can be combined with any of the examples disclosed above, the traffic server designates a decision point as closed, the traffic server updates a route information message designated for road users approaching the closed decision point, wherein the rout information is pointing the road user in a direction towards a location of an open decision point being located in a shortest possible distance from the closed decision point, alternatively, the rout information points the road user towards a road connection through the closed decision point having a traffic flow level above a third predefined traffic flow level.

According to another example of embodiment, which can be combined with any of the examples disclosed above, the traffic server is configured to execute steps of:

assembling traffic messages from analysed reports or information about traffic incidents or events, and further identifying a geographical extent of an area being valid for a content of a specific assembled traffic message within the computer coded map, then updating a traffic message buffer of all virtual traffic guides residing inside the identified geographical area, when the traffic server system identifies a moving road users approaching a specific virtual traffic guide, the traffic server transmit the last traffic message being updated in the traffic message distribution buffer of the specific virtual guide to the approaching road user.

According to another example of embodiment, which can be combined with any of the examples disclosed above, wherein at least one name of a geographical area associated with the location of a virtual traffic guide in the map of the geographical area can be a linked list of associated geographical names being from a group of names comprising:

name of a crossing of at least a first and a second street, name of block of houses, name of district, name of an area close to the junction, neighbourhood, city, geographical area, According to another example of embodiment, which can be combined with any of the examples disclosed above, the traffic server is configured to detect an approaching road user approaching a virtual traffic guide, or a designated open decision point, a designated closed decision point, or a candidate decision point, or a virtual helper by:

identifying a union between a defined field around the virtual traffic guide, or the designated open decision point, or the designated closed decision point, or the candidate decision point, or the virtual helper and a defined radar field around the approaching road user.

According to another example of embodiment, which can be combined with any of the examples disclosed above, wherein geographical locations of respective virtual traffic guides in a Map Information Layer (MIL), the MIL is then downloaded to the mobile terminals of the road users, and which are superimposed on copies of the map of the geographical area the traffic server is monitoring, and which is residing in respective mobile terminals.

According to another example of embodiment, which can be combined with any of the examples disclosed above, wherein the mobile terminals are equipped with GPS transceivers, and is further configured to update GPS positions of a moving specific mobile terminal in the copy of the map residing in the specific mobile terminal, and is further configured to detect an event when a defined radar field around the mobile terminal is in a union with a defined traffic information field around the virtual traffic guide of any type the road user is approaching.

According to another example of embodiment, which can be combined with any of the examples disclosed above, the traffic server is further configured to allocate at least one virtual helper on a crossing road in a distance from a junction associated with a virtual traffic guide, wherein the at least one virtual helper is issuing a questionnaire to road users approaching the at least one virtual helper.

According to another example of embodiment, which can be combined with any of the examples disclosed above, wherein road users receiving the questionnaire are responding to questions in the questionnaire by responding with a "yes", "no" or a number, or by selecting one answer among several answers that are closest to the answer the road user think is the correct answer.

According to another example of embodiment, which can be combined with any of the examples disclosed above, the traffic server is configured to execute steps of:

acquiring historical data about travels of an approaching road user before analysing and assembling a traffic message designated for the approaching road user, and taking into account any relevant information about further possible travel the road user likely will do when passing the junction associated with the virtual traffic guide or decision point the road user is approaching.

According to another example of embodiment, which can be combined with any of the examples disclosed above, wherein inbound and outbound traffic lanes of named roads in and out of a first virtual traffic guide being in common with named roads of a second virtual traffic guide are:

configured with a straight line stretching across a width of the respective lanes in the computer coded map in front of the first virtual traffic guide and the second virtual traffic guide, the straight lines are serving as a geofences, and the traffic server is configured to detect crossings of the respective geofences, and updating a table associated with the respective traffic lanes of respective named roads with a road user identity when a road user is crossing a geofence in front of the first virtual traffic guide on an outbound traffic lane relative to the first virtual traffic guide, and removing the road user identity from the table when the road user is crossing a geofence in front of the second virtual geofence on an inbound traffic lane relative to the second virtual traffic guide.

According to another example of embodiment, which can be combined with any of the examples disclosed above, the traffic server is configured to measuring a rate of updating of road users in a table, which then is a measure of flux into a road, measuring a rate of removal of road users from the table, which then is a measure of flux out of the road, if the flux into a road is larger than the flux out of the road, issue a warning of possible start of a congestion on the road, if the flux into a road is less than the flux out of the road, issue an information of diminishing traffic flow problems on the road, if the flux into a road is approximately equal to the flux out of the road, issue an information of no change in traffic conditions on the road.

According to another example of embodiment, which can be combined with any of the examples disclosed above, whenever a warning of possible congestion is issued, notify the virtual traffic guides having the roads in common to issue a warning about the possible problem ahead to approaching road users approaching the virtual traffic guides, then evaluate the number of road users being updated in the respective tables associated with the respective roads in and out of the junctions associated with the virtual traffic guides, issuing an advice to an approaching road user to turn into another road having the least number of road users present as identified in the corresponding tables, thereby distributing approaching road users on a plurality of roads away from the road with congestion.

According to another example of embodiment, which can be combined with any of the examples disclosed above, the traffic server is configured to:

accepting road user request of sending out virtual cars from a user selected geographical position in the computer coded map, wherein the respective virtual cars moves in a user defined plurality of directions like north, north-west, south, south west etc. out from the user selected geographical position, wherein the traffic server reports back to the road user possible routes from the user selected geographical position in the user defined directions, wherein the routes do not pass through closed decision points, but only open decision points, thereby enabling a road user to plan a rout with probably less traffic problems.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. In addition, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A computer implemented method of wireless distribution of traffic related messages and guidance to road users having mobile terminals travelling on a road system being monitored by a traffic server, wherein the traffic server is configured to store thereon a computer-coded map of a geographical area comprising the road system, and the traffic server is further configured to store thereon a program that, when executed, causes the traffic server to execute the steps of:

allocating virtual traffic guides in a plurality of junctions being represented in the computer coded map of the road system, associating all road names, or road identifications, leading in and out of the respective junctions associated with virtual traffic guides, and maintaining and updating a record of traffic flow levels on inbound and outbound traffic lanes of roads relative to each one of the virtual traffic guides, the traffic server is configured to acquire on a regular basis, or on an event driven basis, reports or information regarding traffic related incidents or events on the monitored road system, when the traffic server is analysing a specific report or information regarding a specific traffic incident or event, the traffic server is designating virtual traffic guides as decision points in the computer coded map at junctions having roads in common with roads in a geographical area surrounding an identified geographical location of the traffic incident or event, wherein the decision points are surrounding the geographical location of the incident or event, in a distance from the incident or event being assessed by the traffic server as defining an initial impact area size of the incident or event, evaluating the recorded and updated traffic flow levels of the named roads in and out of the respective decision points, and each decision point is designated as an open or closed decision point according to a result of the evaluation the traffic levels, wherein:

a decision point is designated as an open decision point if at least one inbound traffic lane relative to the decision point of a first named road is having a traffic flow level above a first predefined threshold level, and at least one outbound traffic lane relative to the decision point of a second named road is having a traffic flow level above a predefined second threshold level, thereby there is at least one road connection through the associated junction that has an acceptable traffic flow condition, a decision point is designated as a closed decision point if none of the roads of a decision point have a traffic flow level above the predefined threshold levels, or just one lane of a road has a traffic flow level above the predefined threshold levels, and designating virtual traffic guides having the named roads in common with the closed decision point(s) as candidates for being an open decision point, wherein candidate decision points are designated as open or closed decision points after an outcome of an analysis of the traffic flow levels of roads associated with the respective candidate decision points, when a candidate decision point is a closed decision point, then continuing evaluating further candidate decision points located away from the closed candidate decision point away from the geographical location of the traffic incident or event, until an open decision point is identified, thereby an impact area around a reported traffic incident or event is bounded by open decision points around a periphery of the impact area, and when a road user is detected to be approaching the impact area by the traffic server, the traffic server detects which open decision point the road user is approaching, the traffic server then informs the approaching road user about the at least one road connection with an acceptable traffic flow level through the associated junction of the open decision point the road user is approaching, thereby the road user can avoid entering the impact area of the traffic incident or event.

2. The method according to claim 1, wherein the traffic server is configured to execute a step of assigning to a one-way street being common between two virtual traffic guides, a traffic flow level of zero in a driving direction opposite the one-way road direction.

3. The method according to claim 1, wherein the traffic server is further configured to associate an indication of named roads in and out of the virtual traffic guides as open roads if the outcome of the analysis is that the respective traffic flow levels are above the predefined threshold levels, otherwise as closed roads.

4. The method according to claim 3, wherein the traffic server is configured to assign a dead-end road as a closed road.

5. The method according to claim 1, wherein the respective threshold levels are tuned with respect to overall traffic conditions in the geographical area.

6. The method according to claim 3, wherein the traffic server is further configured to check conflicting status of a named road by comparing the status recorded in at least two virtual traffic guides having a named road in common, and if there is a conflict of status, resolve the conflict by assigning the named road as a closed road in the at least two virtual traffic guides having the road in common.

7. The method according to claim 1, wherein the evaluation of the traffic flow levels of named roads associated with respective decision points, or candidate decision points, further comprises the steps of:

if there is only one outbound traffic lane with an acceptable traffic flow level associated with a first decision point, then identify if the outbound lane is on a named one-way road from the first decision point to a second decision point having the named one-way road in common, and then identify if the second decision point has at least one other outbound traffic lane with an acceptable traffic flow level, then designating the first decision point as an open decision point, otherwise, the first decision point is designated as closed.

8. The method according to claim 1, wherein the evaluation of the traffic flow levels of named roads associated with respective decision points, or candidate decision points, further comprises the steps of:

if there is only one outbound traffic lane with an acceptable traffic flow level associated with a first decision point, then identify if the outbound lane is on a named one-way road from the first decision point to a second decision point having the named one-way road in common, and then identify if the second decision point has registered a traffic flow level being higher or equal than the acceptable traffic flow level of the first decision point, then designating the first decision point as an open decision point, otherwise, the first decision point is designated as closed.

9. The method according to claim 1, wherein the traffic server is configured to evaluate traffic flow levels of named roads associated with decision points regularly, thereby respectively changing a designation of a specific decision point from open to closed, or from closed to open, dependent on an outcome of the evaluation of the traffic flow levels.

10. The method according to claim 1, whenever the traffic server designates a decision point as closed, the traffic server updates a route information message designated for road users approaching the closed decision point, wherein the route information is pointing the road user in a direction towards a location of an open decision point being located in a shortest possible distance from the closed decision point, alternatively, the route information points the road user towards a road connection through the closed decision point having a traffic flow level above a third predefined traffic flow level.

11. The method according to claim 1, wherein the traffic server is configured to execute steps of:

assembling traffic messages from analysed reports or information about traffic incidents or events, and further identifying a geographical extent of an area being valid for a content of a specific assembled traffic message within the computer coded map, then updating a traffic message buffer of all virtual traffic guides residing inside the identified geographical area, when the traffic server identifies a moving road user approaching a specific virtual traffic guide, the traffic server transmit a last traffic message being updated in the traffic message buffer of the specific virtual guide to the approaching road user.

12. The method according to claim 1, wherein at least one name of a geographical area associated with the location of a virtual traffic guide in the map of the geographical area can be a linked list of associated geographical names being from a group of names comprising:

name of a crossing of at least a first and a second street, name of a block of houses, name of a district, name of an area close to the junction, neighbourhood, city, geographical area, or postal code.

13. The method according to claim 1, wherein the traffic server is configured to detect an approaching road user approaching a virtual traffic guide, or a designated open decision point, a designated closed decision point, or a candidate decision point, or a virtual helper by:

identifying a union between a defined field around the virtual traffic guide, or the designated open decision point, or the designated closed decision point, or the candidate decision point, or the virtual helper, and a defined radar field around the approaching road user.

14. The method according to claim 1, wherein geographical locations of respective virtual traffic guides are included in a Map Information Layer (MIL), the MIL is then downloaded to the mobile terminals of the road users, and which are superimposed on copies of the map of the geographical area the traffic server is monitoring, and which is residing in respective mobile terminals.

15. The method according to claim 9, wherein the mobile terminals are equipped with GPS transceivers, and is further configured to update GPS positions of a moving specific mobile terminal in the copy of the map residing in the specific mobile terminal, and is further configured to detect an event when a defined radar field around the mobile terminal is in a union with a defined traffic information field around the virtual traffic guide of any type the road user is approaching.

16. The method according to claim 1, wherein the traffic server is further configured to allocate at least one virtual helper on a crossing road in a distance from a junction associated with a virtual traffic guide, wherein the at least one virtual helper is issuing a questionnaire to road users approaching the at least one virtual helper.

17. The method according to claim 16, wherein road users receiving the questionnaire are responding to questions in the questionnaire by responding with a "yes", "no" or a number, or by selecting one answer among several answers that are closest to the answer the road users think is the correct answer.

18. The method according to claim 1, wherein the traffic server is configured to execute steps of:

acquiring historical data about travels of an approaching road user before analysing and assembling a traffic message designated for the approaching road user, and taking into account any relevant information about further possible travel the road user likely will do when passing the junction associated with the virtual traffic guide or decision point the road user is approaching.

19. The method according to claim 1, wherein inbound and outbound traffic lanes of named roads in and out of a first virtual traffic guide being in common with named roads of a second virtual traffic guide are:

configured with a straight line stretching across a width of the respective lanes in the computer coded map in front of the first virtual traffic guide and the second virtual traffic guide, the straight lines are serving as a geofences, and the traffic server is configured to detect crossings of the respective geofences, and updating a table associated with the respective traffic lanes of respective named roads with a road user identity when a road user is crossing a geofence in front of the first virtual traffic guide on an outbound traffic lane relative to the first virtual traffic guide, and removing the road user identity from the table when the road user is crossing a geofence in front of the second virtual geofence on an inbound traffic lane relative to the second virtual traffic guide.

20. The method according to claim 19, wherein the traffic server is configured to measure a rate of updating of road users in a table, which then is a measure of flux into a road, measure a rate of removal of road users from the table, which then is a measure of flux out of the road, if the flux into a road is larger than the flux out of the road, issue a warning of possible start of a congestion on the road, if the flux into a road is less than the flux out of the road, issue an information of diminishing traffic flow problems on the road, if the flux into a road is approximately equal to the flux out of the road, issue an information of no change in traffic conditions on the road.

21. The method according to claim 20, whenever a warning of possible congestion is issued, notify the virtual traffic guides having the road in common to issue a warning about the possible problem ahead to approaching road users approaching the virtual traffic guides, then evaluate the number of road users being updated in the respective tables associated with the respective roads in and out of the junctions associated with the virtual traffic guides, and issue an advice to an approaching road user to turn into another road having the least number of road users present as identified in the corresponding tables, thereby distributing approaching road users on a plurality of roads away from the road with congestion.

22. The method according to claim 1, wherein the traffic server is configured to:

accept a road user request of sending out virtual cars from a user selected geographical position in the computer coded map, wherein the respective virtual cars move in a user defined plurality of directions including north, north-west, south, and south west out from the user selected geographical position, wherein the traffic server reports back to the road user possible routes from the user selected geographical position in the user defined directions, wherein the routes do not pass through closed decision points, but only open decision points, thereby enabling a road user to plan a route with probably less traffic problems.

23. A computer server system being configured to execute the computer implemented method of claim 1.

* * * * *